US009903638B2

(12) United States Patent
Dubina et al.

(10) Patent No.: US 9,903,638 B2
(45) Date of Patent: Feb. 27, 2018

(54) HINGE ASSEMBLY FOR A REFRIGERATOR

(71) Applicant: Electrolux Home Products, Inc, Charlotte, NC (US)

(72) Inventors: Paul Dubina, Anderson, SC (US); Cory Simpson, Abbeville, SC (US); Adam Ellis, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 146 days.

(21) Appl. No.: 14/013,574

(22) Filed: Aug. 29, 2013

(65) Prior Publication Data

US 2015/0059126 A1 Mar. 5, 2015

(51) Int. Cl.

| | |
|---|---|
| ***E05D 7/00*** | (2006.01) |
| ***F25D 23/02*** | (2006.01) |
| ***E05D 11/06*** | (2006.01) |
| ***E05D 5/12*** | (2006.01) |
| ***E05D 7/02*** | (2006.01) |
| *E05D 11/10* | (2006.01) |

(52) U.S. Cl.

CPC ..... *F25D 23/028* (2013.01); *E05D 5/121* (2013.01); *E05D 7/00* (2013.01); *E05D 7/02* (2013.01); *E05D 11/06* (2013.01); *E05D 2005/122* (2013.01); *E05D 2011/1035* (2013.01); *E05Y 2900/31* (2013.01); *F25D 2323/022* (2013.01); *F25D 2323/024* (2013.01); *Y10T 16/54* (2015.01)

(58) Field of Classification Search

CPC ..... F25D 2323/024; F25D 23/028; Y10T 16/539; Y10T 16/53987; Y10T 16/53988; Y10T 16/53992; E05Y 2900/31

See application file for complete search history.

(56) References Cited

U.S. PATENT DOCUMENTS 2,839,779 A * 6/1958 Haag ..... 16/375
3,531,824 A 10/1970 Hagendoorn et al.

(Continued)

FOREIGN PATENT DOCUMENTS

EP 318422 A1 * 5/1989 ..... E05D 7/04
EP 2573491 A2 3/2013

(Continued)

OTHER PUBLICATIONS

International Search Report and Written Opinion issued in Application No. PCT/US2014/053395 dated Nov. 25, 2014.

*Primary Examiner* — Robert Sandy
*Assistant Examiner* — Matthew J Sullivan
(74) *Attorney, Agent, or Firm* — Pearne & Gordon LLP

(57) ABSTRACT

A hinge assembly is provided for pivotally mounting a door on a refrigerator cabinet. The refrigerator cabinet includes a top wall, a bottom wall, a pair of opposed side walls extending between the bottom and top wall, and a face that is normal to the top wall, bottom wall, and opposed side walls. The hinge assembly includes a hinge bracket, hinge pin, and door stop member. The hinge bracket is attachable to the cabinet and includes a threaded aperture having a first end and a second end. The hinge pin defines an axis about which the door can rotate and is threadably insertable into either end of the threaded aperture. The door stop member is configured to rotate about the axis and prohibit rotation of the door beyond a certain position.

17 Claims, 11 Drawing Sheets

(56) References Cited

U.S. PATENT DOCUMENTS

| | | | | |
|---|---|---|---|---|
| 3,863,391 | A | 2/1975 | Horvay et al. | |
| 4,151,681 | A * | 5/1979 | Roberts | E05D 3/04 312/321.5 |
| 4,774,740 | A * | 10/1988 | Gidseg et al. | 16/344 |
| 4,864,691 | A | 9/1989 | Gidseg et al. | |
| 5,187,837 | A | 2/1993 | Gunderson et al. | |
| 5,369,842 | A * | 12/1994 | Beatty | 16/317 |
| 8,235,480 | B2 | 8/2012 | Kang | |
| 2006/0244351 | A1 | 11/2006 | Moon et al. | |
| 2010/0043293 | A1 | 2/2010 | Nicholson et al. | |
| 2013/0154464 | A1 * | 6/2013 | Fiori | E05D 7/0423 312/405 |
| 2013/0249371 | A1 * | 9/2013 | Lively et al. | 312/404 |
| 2013/0249373 | A1 * | 9/2013 | Lively | E05D 7/0027 312/405 |
| 2014/0232251 | A1 * | 8/2014 | Kim et al. | 312/404 |
| 2014/0259529 | A1 * | 9/2014 | Jenkinson | E05D 7/0027 16/248 |

FOREIGN PATENT DOCUMENTS

| | | | |
|---|---|---|---|
| EP | 2789944 | A2 * | 10/2014 |
| JP | S57119290 | U | 7/1982 |
| KR | 100262397 | B1 | 8/2000 |
| KR | 20060116435 | A | 11/2006 |
| WO | 2007/094523 | A1 | 8/2007 |
| WO | 03/097974 | A2 | 3/2013 |

* cited by examiner

HINGE ASSEMBLY FOR A REFRIGERATOR

BACKGROUND OF THE INVENTION

Field of the Invention

This application relates generally to a hinge assembly for mounting a door to a refrigerator cabinet, and more specifically, to a hinge assembly that can permit mounting of the door to either side of the cabinet.

Description of Related Art

Generally, a refrigerator is an electrical appliance that keeps food fresh in a storage compartment for a long time by maintaining an interior temperature thereof to be lower than an exterior temperature. The storage compartment is defined by a main body of the refrigerator. The refrigerator generates cool air as a refrigerant circulates a cooling cycle and supplies the cool air to the storage compartment to maintain the food in the storage compartment at a predetermined low temperature.

Often, a refrigerator will have multiple storage compartments. For example, a refrigerator may include both a fresh food compartment and a freezer compartment. The fresh food compartment is where food items such as fruits, vegetables, and beverages are stored and the freezer compartment is where food items that are to be kept in a frozen condition are stored. In some cases, the freezer compartment and the fresh food compartment will be vertically aligned, with one compartment above the other.

Typically, a door is pivotally installed on the main body using hinges that are connected to a face of the cabinet and extend forwardly from a side of the cabinet to which the door opens. One hinge is provided above the door to secure a top portion of the door while another hinge is provided below the door to secure a bottom portion of the door. For refrigerators with multiple compartments that are vertically aligned, a top door may be pivotally installed for the top compartment and a bottom door may be installed for the bottom compartment using the hinges described above. Moreover, a middle hinge may be mounted between the top and bottom doors that secures both the top and bottom doors to the cabinet.

SUMMARY

According to one aspect, the subject application involves a hinge assembly for pivotally mounting a door on a refrigerator cabinet. The refrigerator cabinet comprises a top wall, a bottom wall, a pair of opposed side walls extending between the bottom and top wall, and a face that is normal to the top wall, bottom wall, and opposed side walls. The hinge assembly comprises a hinge bracket, hinge pin, and a door stop member. The hinge bracket is attachable to the cabinet and comprises a threaded aperture having a first end and a second end. The hinge pin defines an axis about which the door can rotate and is threadably insertable into either end of the threaded aperture. The door stop member is configured to rotate about the axis and prohibit rotation of the door beyond a certain position.

According to another aspect, the subject application involves a hinge assembly for mounting a door on a refrigerator cabinet. The hinge assembly comprises a hinge bracket, hinge pin, and a door stop member. The hinge bracket is attachable to the cabinet. The hinge pin defines an axis about which the door can rotate. The hinge pin comprises an upper portion extending from the hinge bracket in a first direction and a lower portion extending from the hinge bracket in a second direction that is opposite the first direction. The lower portion comprises a circumferential surface portion and a key portion.

According to yet another aspect, the subject invention involves a hinge assembly for mounting a door on a refrigerator cabinet. The refrigerator cabinet comprises a top wall, a bottom wall, a pair of opposed side walls extending between the bottom and top wall, and a face that is normal to the top wall, bottom wall, and opposed side walls. The hinge assembly comprises a hinge bracket, hinge pin, and door stop member. The hinge bracket is attachable to the cabinet. The hinge pin defines an axis about which the door can rotate. The hinge pin extends from the hinge bracket and is configured for insertion into a hole in the door. The door stop member is configured to prohibit rotation of the door beyond a certain position. The door stop member comprises a first aperture and a second aperture. The hinge pin extends through only one of the first and second apertures.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION

Figure 1:
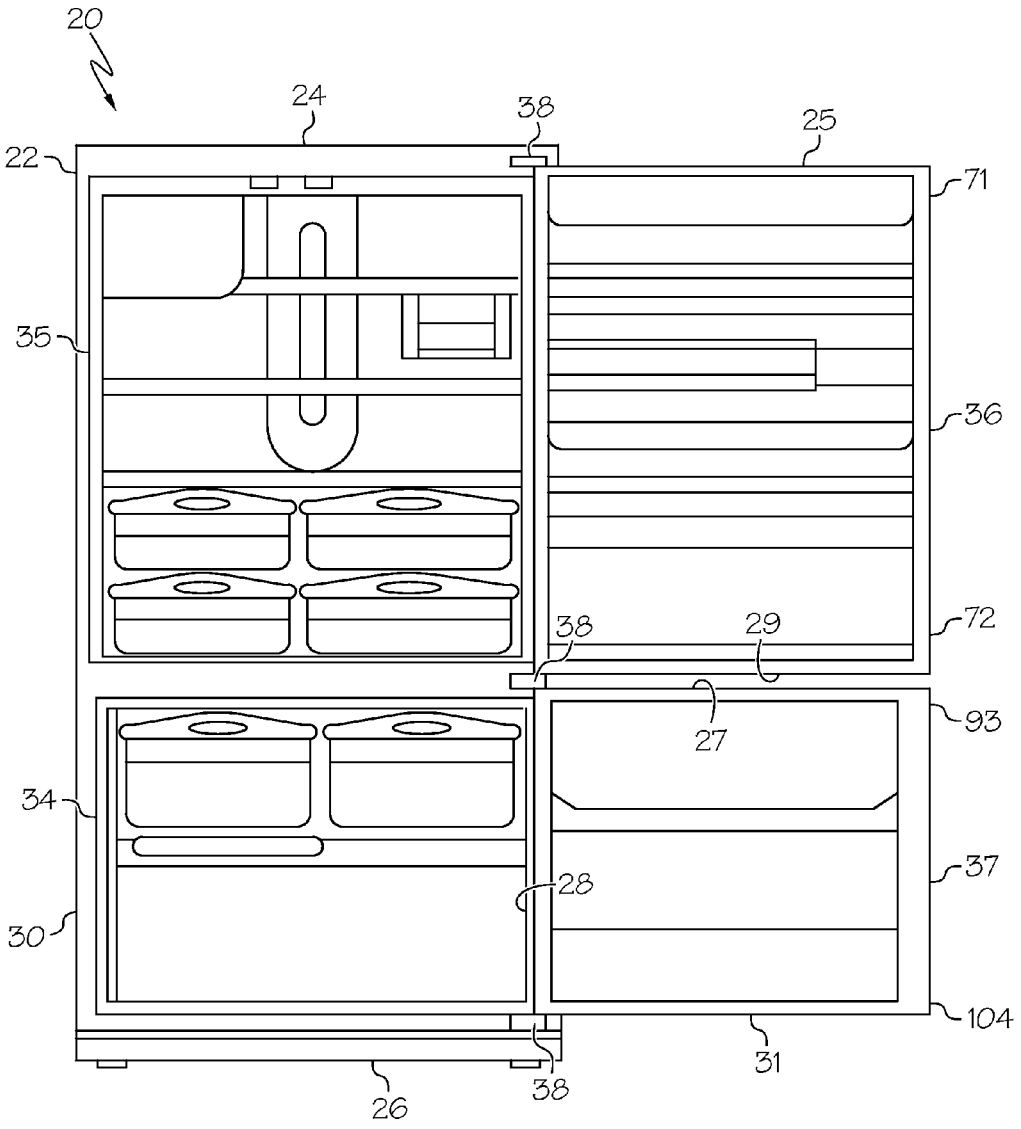
FIG. 1 shows a perspective view of an embodiment of a refrigerator having a fresh food compartment and freezer compartment.

Relative language used herein is best understood with reference to the drawings, in which like numerals are used to identify like or similar items. Further, in the drawings, certain features may be shown in somewhat schematic form.

Referring to FIG. 1, there is illustrated a refrigeration appliance in the form of a domestic refrigerator, indicated generally at 20. The refrigerator 20 comprises a cabinet 22 having a top wall 24, a bottom wall 26, and a pair of opposed side walls 28, 30 extending normally from and between the bottom wall 26 and top wall 24. The cabinet 22 further comprises a face 32 that is normal to the top wall 24, bottom wall 26, and the pair of opposed side walls 28, 30. The refrigerator 20 includes a freezer compartment 34 vertically disposed below a fresh-food compartment 35. Additionally, doors 36, 37 are provided to provide access to each compartment 34, 35. Each door 36, 37 is pivotally installed on the cabinet 22 using hinges 38 that are attached to the cabinet 22 and configured so that each door 36, 37 opens towards a side of the cabinet 22. The doors 36, 37 are arranged so that top surfaces 25, 27 and bottom surfaces 29, 31 of the doors 36, 37 are substantially parallel to the top wall 24 and bottom wall 26.

Although FIG. 1 shows a refrigerator 20 which includes a freezer compartment 34 vertically disposed below a fresh-food compartment 35, the compartments 34, 35 may be arranged according to other configurations. For example, the fresh-food compartment 35 may be vertically disposed below the freezer compartment 34 or the two compartments 34, 35 may be side by side. Alternatively, the refrigerator 20 may only have a single compartment. The refrigerator 20 can have any desired configuration including a cabinet and a door without departing from the scope of the invention.

Figure 2:
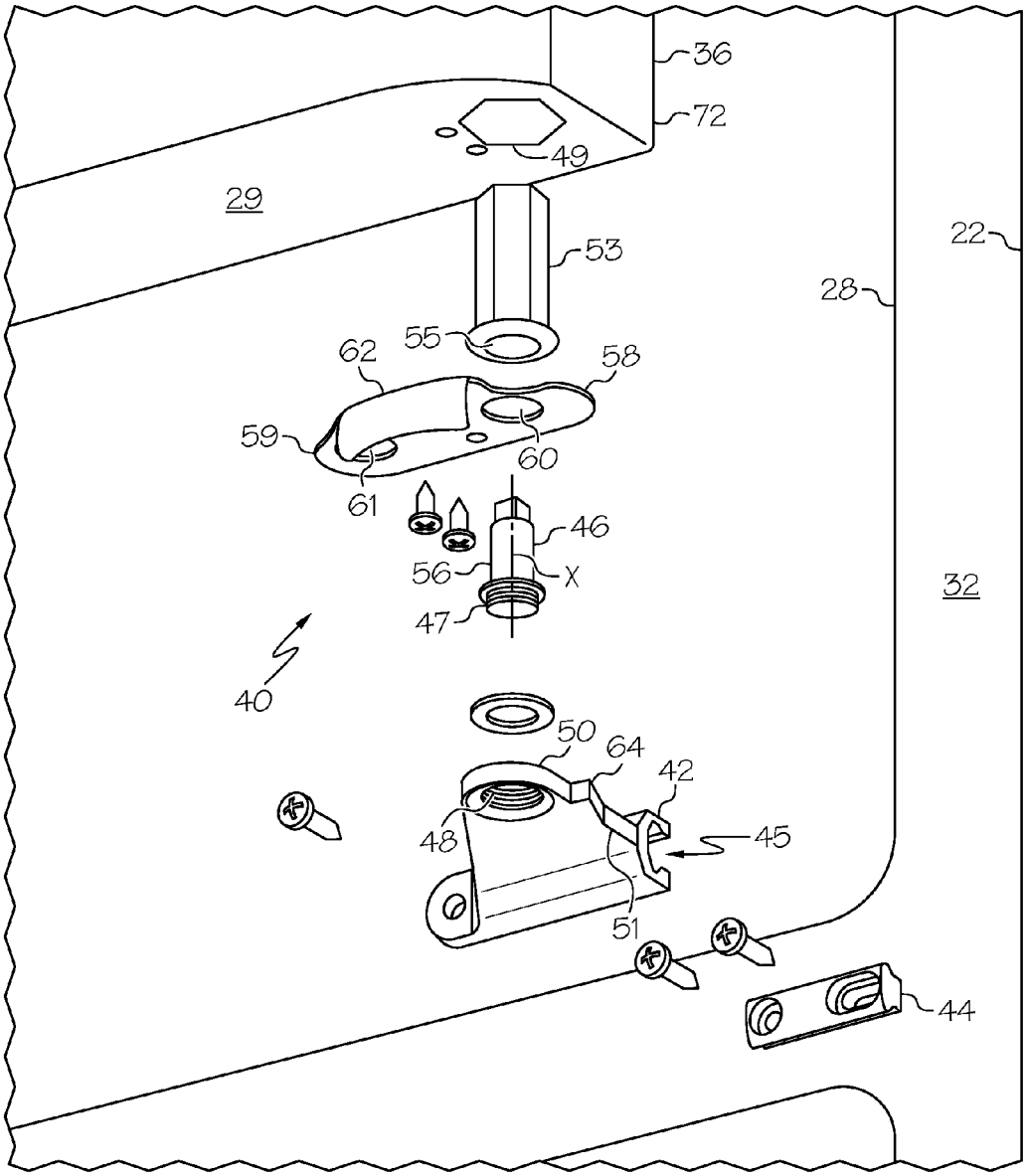
FIG. 2 shows an exploded view of a configuration for a hinge assembly comprising a hinge pin.

FIG. 2 shows an exploded view of a hinge assembly 40 that may be used to attach the doors 36, 37 to the cabinet 22. The hinge assembly 40 comprises a hinge bracket 42 that is attachable to the face 32 of the cabinet 22 using a mounting block 44. The mounting block 44 may be attached to the face 32 using screws, bolts, or any other fastening means. The hinge bracket 42 includes a track 45 that mates with the mounting block 44 so that the hinge bracket 42 can slidably engage the mounting block 44. Once the mounting block 44 is fastened to the cabinet 22, the hinge bracket 42 can thus slide onto the mounting block 44, securing the hinge bracket 42 to the cabinet 22 so that the hinge bracket extends normally from the face 32 of the cabinet 22. Additionally, the hinge bracket 42 may be fastened to the cabinet 22 using a screw or other attachment means to prohibit the hinge bracket 42 from disengaging with the mounting block 44. Although the hinge bracket 42 shown in the present embodiment is attached to the cabinet 22 using mounting block 44, other structure may be used besides the mounting block 44 to attach the hinge bracket 42 to the cabinet 22. Moreover, the hinge bracket 42 can be directly attached to the cabinet 22 in other embodiments without use of the mounting block 44 or alternative structure. Additionally, the hinge bracket 42 may be attached to other supportive portions of the cabinet 22 without departing from the scope of the invention. For example, the hinge bracket 42 may be attached to the top wall 24, bottom wall 26, or either of the opposed side walls 28, 30. Furthermore, although the hinge bracket 42 is arranged so that side 50 of the hinge bracket 42 faces upward and side 51 faces downward, there may be other configurations of the hinge assembly 40 wherein the hinge bracket 42 has a different orientation. For example, in certain configurations, the side 51 may face upward while the side 50 faces downward.

In addition to the hinge bracket 42, the hinge assembly 40 in the present embodiment comprises a hinge pin 46. The hinge pin 46 may be integral with the hinge bracket 42 or it may be a separate component that is selectively attachable to the hinge bracket 42. The hinge pin 46 in the present example is separate from the hinge bracket 42 and includes a threaded portion 47 at an end of the hinge pin 46 which allows the hinge pin 46 to be threadably attached to the hinge bracket 42. More specifically, the hinge bracket 42 has a threaded aperture 48 that is configured to receive the threaded portion 47. The threaded aperture 48 is threaded from both ends of the aperture so that the hinge pin 46 can be threadably inserted into either end of the threaded aperture 48. Thus, the hinge pin 46 will extend from the hinge bracket 42 in one direction if threaded into one end of the threaded aperture 48. Meanwhile, the hinge pin 46 will extend from the hinge bracket 42 in an opposite direction if threaded into the opposite end of the threaded aperture 48.

The hinge pin 46 defines an axis X about which a refrigerator door can rotate. Additionally, the hinge pin 46 is configured for insertion into a hole in the door. Moreover, the hinge assembly 40 may comprise a spin bearing 53 that can be inserted into the hole to provide a bearing surface for the hinge pin 46 to engage. For example, as shown in FIG. 2, the hinge assembly 40 can be assembled and mounted to the cabinet 22 such that the hinge pin 46 extends from the side 50 of the hinge bracket 42 and into a hole 49 in the bottom surface 29 of the door 36. Additionally, the spin bearing 53 is inserted into the hole 49 to provide a bearing surface for the hinge pin 46 to engage. The hole 49 preferably has a non-circular geometry that matches the outer shape of the spin bearing 53 so that the spin bearing 53 is fixed within the hole 49 and does not rotate relative to the door 36. Meanwhile, the inner surface 55 of the spin bearing 53 and the outer surface of portion 56 of the hinge pin 46 are preferably circular in cross-section so that the door 36 and the spin bearing 53 may freely rotate about the portion 56 of the hinge pin 46 when the hinge assembly 40 is assembled and mounted to the door 36.

The hinge assembly 40 further comprises a door stop member 58 configured to prohibit rotation of the door beyond a certain position. The door stop member 58 comprises a plate 59 having a first aperture 60 and a second aperture 61 and a stop portion 62 that extends from the plate 59 towards the hinge bracket 42 when the hinge assembly 40 is assembled. The first aperture 60 and second aperture 61 are configured so that the hinge pin 46 extends through one of the apertures 60, 61 when assembled. Additionally, the hinge bracket 42 comprises a protrusion 64 configured to cooperate with the door stop member 58 to prohibit rotation of the door beyond the certain position. For example, as shown in FIG. 2, the hinge assembly 40 can be assembled and mounted to the cabinet 22 such that the side 50 of the hinge bracket 42 faces upward and the hinge pin 46 extends vertically upward from the hinge bracket 42, through the first aperture 60, and into the hole 49 in the door 36. The door stop member 58 can be fixed to the bottom surface 29 of the door 36 using a set of screws or other fastening means so that the door stop member 58 rotates with the door 36 about the axis X of the hinge pin 46. Thus, as the door 36 is rotated open towards the side wall 28, the stop portion 62 of the door stop member 58 will eventually engage with the protrusion 64 on the mounted hinge bracket 42, prohibiting any further rotation of the door 36 in the opening direction. The location of the protrusion 64 on the hinge bracket 42 and the width of the stop portion 62 can be designed so that the door 36 will not open past a desired angle relative to the face 32 of the cabinet 22.

Figure 3:
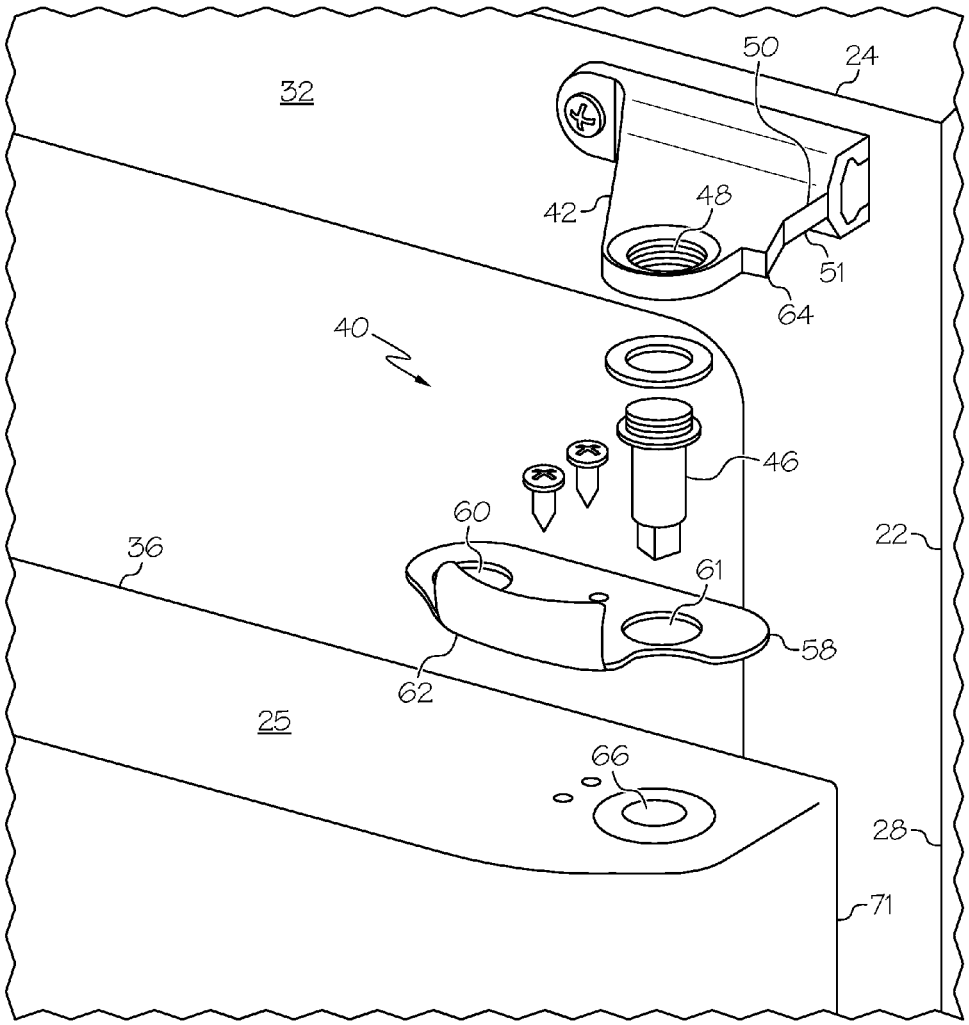
FIG. 3 shows an exploded of another configuration for the hinge assembly.

The hinge bracket 42, hinge pin 46, and door stop member 58 of the hinge assembly 40 described above are configured to permit mounting of a door to a refrigerator cabinet with the hinge assembly 40 such that the hinge pin 46 may extend vertically upward from the hinge bracket 42 into a hole in a bottom surface of a door or vertically downward from the hinge bracket 42 into a hole in a top surface of the door. Additionally, the hinge bracket 42, hinge pin 46, and door stop member 58 of are further configured to permit mounting of the door to the refrigerator cabinet with the hinge assembly 40 such that the door can pivot near either side wall of the refrigerator. Depending on which mounting configuration is desired, the vertical orientation and alignment of these elements may be altered so that the door will pivot near the desired side wall and the stop portion 62 of the door stop member 58 will properly engage with the protrusion 64 of the hinge bracket 42 as the door opens to prohibit further rotation of the door in the opening direction. Thus, the same hinge assembly may be used to secure both top and bottom portions of the door to the cabinet so that the door can pivot near either side wall of the cabinet. For example, as shown in FIG. 2, the hinge assembly 40 may be assembled and mounted below the door 36 so that the hinge pin 46 extends vertically upward from the hinge bracket 42, through the first aperture 60 in the door stop member 58, and into the hole 49 in the bottom surface 29 of the door 36. Meanwhile, as shown in FIG. 3, the hinge assembly 40 can be assembled and mounted above the door 36 so that the hinge pin 46 extends from the hinge bracket 42 into a hole 66 in the top surface 25 of the door 36. The orientation and alignment of the hinge bracket 42, hinge pin 46, and door stop member 58 are altered from the configuration shown in FIG. 2 so that the hinge pin 46 now extends vertically downward from the hinge bracket 42 and through the second aperture 61 of the door stop member 58 into the hole 66. As a result, the stop portion 62 of the door stop member 58 will properly engage with the protrusion 64 of the hinge bracket 42 as the door 36 opens, prohibiting any further rotation of the door 36 in the opening direction. Thus, the hinge assembly 40 may be configured as shown in FIGS. 2 and 3 to secure both the top portion 71 and the bottom portion 72 of the door 36 such that the door 36 pivots near the side wall 28.

Figure 4:
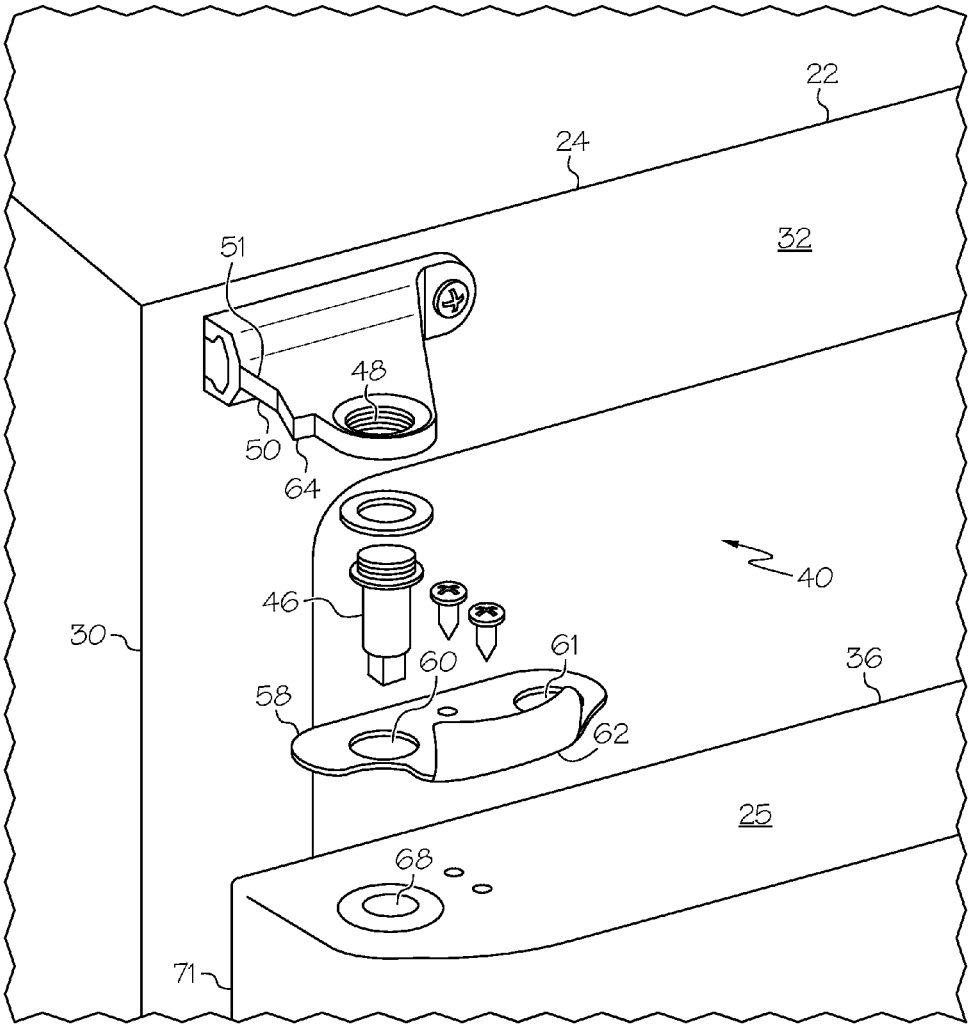
FIG. 4 shows an exploded view of yet another configuration for the hinge assembly.
Figure 5:
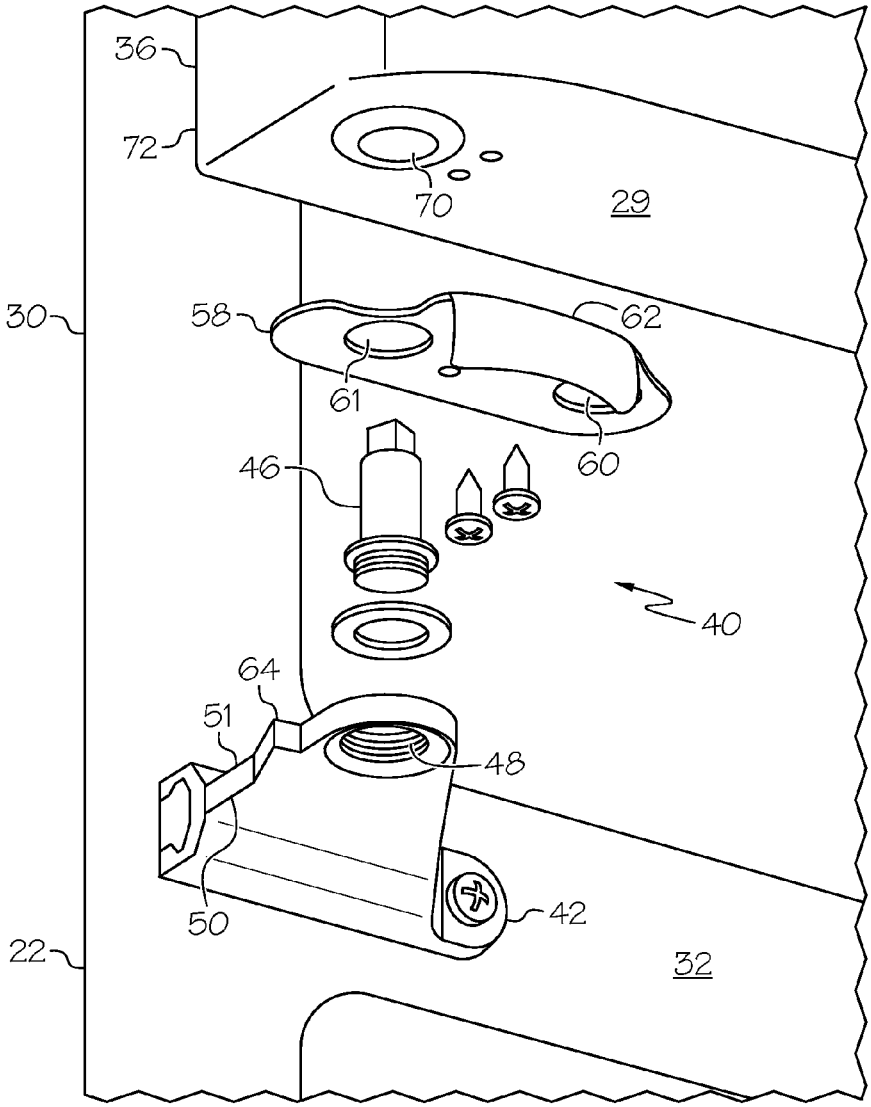
FIG. 5 shows an exploded view of still another configuration for the hinge assembly.

FIGS. 4 and 5 show configurations of the hinge assembly 40 that will permit mounting of the door 36 to the cabinet 22 such that the door 36 may pivot near the side wall 30. As shown in FIG. 4, the hinge pin 46 is threadably attached to the threaded aperture 48 so that it extends vertically downward from the hinge bracket 42 into a hole 68 in the top surface 25 of the door 36. The hinge bracket 42 is arranged so that the side 51 faces upward and the side 50 faces downward. Meanwhile, the hinge pin 46 is arranged so that it extends from the hinge bracket 42 and through the first aperture 60 of the door stop member 58 into the hole 68. As a result, the stop portion 62 of the door stop member 58 will properly engage the protrusion 64 of the hinge bracket 42 as the door 36 opens, prohibiting any further rotation of the door 36 in the opening direction. Turning to FIG. 5, the hinge assembly 40 may be assembled and mounted below the door 36 so that the hinge pin 46 extends vertically upward from the hinge bracket 42 into a hole 70 in the bottom surface 29 of the door 36. The hinge bracket 42 remains oriented so that the side 51 faces upward and the side 50 faces downward. Meanwhile, the hinge pin 46 is arranged so that it extends vertically upward from the hinge bracket 42 and through the second aperture 61 of the door stop member 58 into the hole 70. As a result, the stop portion 62 of the door stop member 58 will properly engage the protrusion 64 of the hinge bracket 42 as the door 36 opens, prohibiting any further rotation of the door 36 in the opening direction. Thus, when assembled and mounted according to the configurations shown in FIGS. 4 and 5, the hinge assembly 40 can secure the top portion 71 and the bottom portion 72 of the door 36 to permit the door 36 to pivot near the side wall 30.

Figure 6:
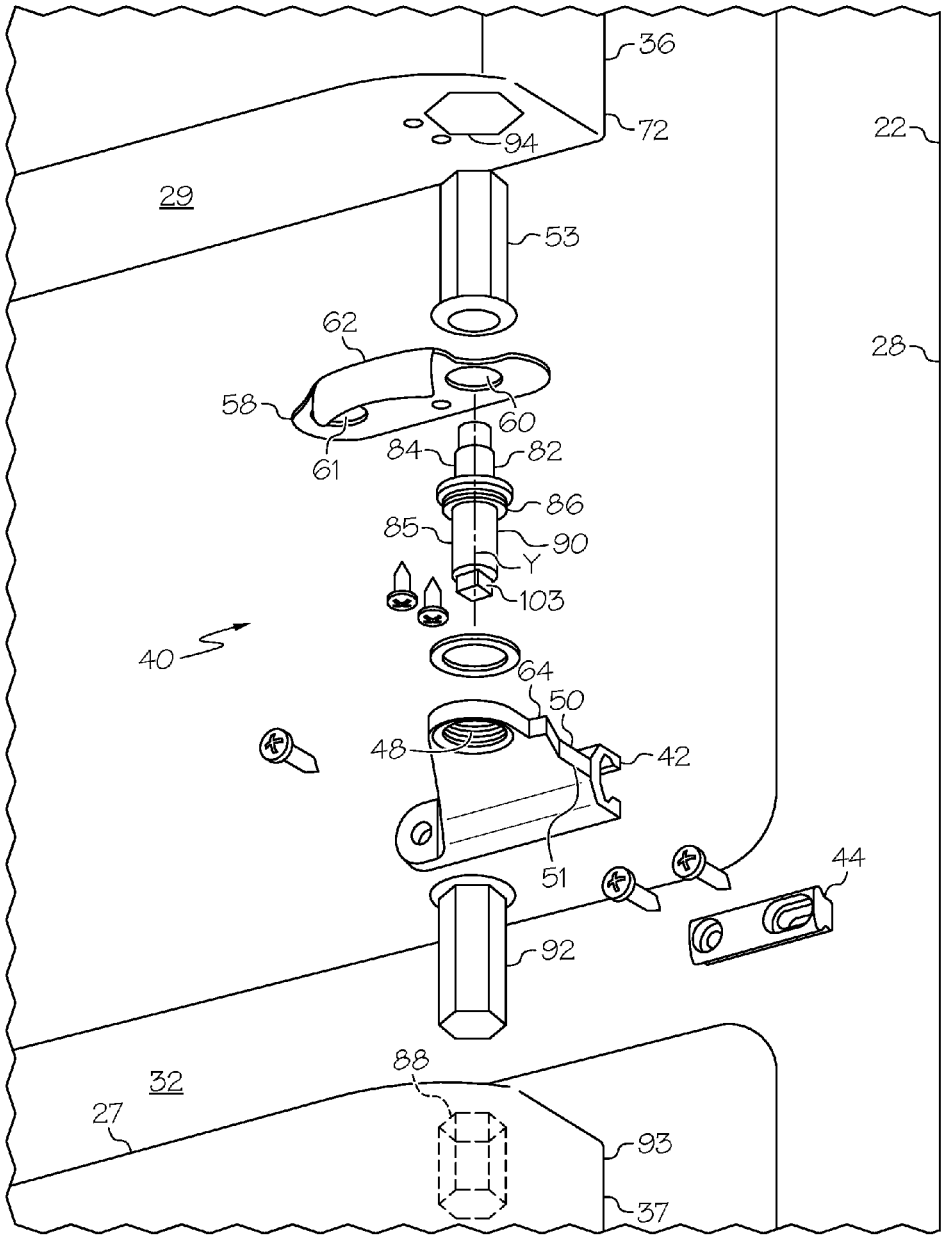
FIG. 6 shows an exploded view of a configuration for the hinge assembly, wherein the hinge assembly comprises an alternate hinge pin.

Turning now to FIG. 6, an embodiment of the hinge assembly 40 is shown wherein an alternative hinge pin 82 is used in place of the hinge pin 46. The hinge pin 82 may be integral with the hinge bracket 42 or it may be a separate component that is selectively attachable to the hinge bracket 42. The hinge pin 82 in the present embodiment is separate from the hinge bracket 42 and comprises an upper portion 84, a lower portion 85, and a threaded portion 86. The threaded portion 86 is threadably attachable to the threaded aperture 48 of the hinge bracket 42 such that when attached, the upper portion 84 extends from the hinge bracket 42 in a first direction and the lower portion 85 extends from the hinge bracket 42 in a second direction that is opposite the first direction. Because the threaded aperture 48 is threaded from both ends of the aperture, the threaded portion 86 can be threadably received in either end of the threaded aperture 48. Thus, regardless of which side 50, 51 of the hinge bracket 42 faces upward, the hinge pin 82 can be attached to the hinge bracket 42 so that the upper portion 84 extends vertically upward from the hinge bracket 42 and the lower portion 85 extends vertically downward.

The hinge pin 82 defines an axis Y about which a refrigerator door can rotate. The upper portion 84 is configured for insertion into a hole in a bottom surface of the door. Additionally, the upper portion 84 is configured to cooperate with the door stop member 58 and the spin bearing 53 in the same manner as described above regarding the hinge pin 46. Meanwhile, the lower portion 85 is configured for insertion into a second hole in a top surface of a second door. Thus, use of the hinge pin 82 permits the hinge assembly 40 to simultaneously secure both the lower portion of a top door and the upper portion of a bottom door to a refrigerator cabinet. For example, as shown in FIG. 6, the hinge assembly 40 can be assembled and mounted to the cabinet 22 such that the side 50 of the hinge bracket 42 faces upward and the upper portion 84 extends vertically upward from the hinge bracket 42, through the first aperture 60 of the door stop member 58, and into the hole 49 in the bottom surface 29 of the door 36. Moreover, the lower portion 85 extends vertically downward from the hinge bracket 42 and into a hole 88 in the top surface 27 of the door 37. The lower portion 85 comprises a circumferential surface portion 90 that is circular in cross-section to provide a smooth, rounded surface for the door 37 to rotate about. Additionally, the hinge assembly 40 can comprise a second spin bearing 92 that is inserted into the hole 88 to provide a bearing surface for the circumferential surface portion 90 to engage. The hole 88 preferably has a non-circular geometry that matches the outer shape of the spin bearing 92 so that the spin bearing 92 is fixed within the hole 88 and does not rotate relative to the door 37. Meanwhile, the inner surface of the spin bearing 92 is preferably cylindrical or slightly conical so that the door 37 and the spin bearing 92 may freely rotate about the circumferential surface portion 90 of the hinge pin 82.

When configured as shown in FIG. 6, the hinge assembly 40 can secure the bottom portion 72 of the door 36 and a top portion 93 of the door 37 to the cabinet 22 so that the doors 36, 37 will pivot near the side wall 28. Additionally, the stop portion 62 of the door stop member 58 will properly engage with the protrusion 64 on the hinge bracket 42 as the door 36 opens, prohibiting any further rotation of the door 36 in the opening direction. Moreover, due to the design of the hinge plate 42, hinge pin 82, and the door stop member 58, the hinge assembly 40 may be reconfigured to secure both the doors 36, 37 to the cabinet 22 so that they will pivot near the left side wall 30. To accomplish this alternate configuration, the hinge assembly 40 can be assembled and mounted to the cabinet 22 such that the side 51 of the hinge bracket 42 faces upward and the upper portion 84 of the hinge pin 82 extends vertically upward from the hinge bracket 42, through the second aperture 61 of the door stop member 58, and into a hole (such as hole 70) in the left side of the bottom surface 29. The lower portion 85 will extend vertically downward from the hinge bracket 42 and can be inserted into a hole in the left side of the top surface 27. Such an arrangement will permit the hinge assembly to secure both the doors 36, 37 to the cabinet 22 so that they will pivot near the side wall 30. Moreover, the stop portion 62 of the door stop member 58 will properly engage with the protrusion 64 on the hinge bracket 42 as the door 36 opens to prohibit further rotation of the door 36 in the opening direction.

Figure 7:
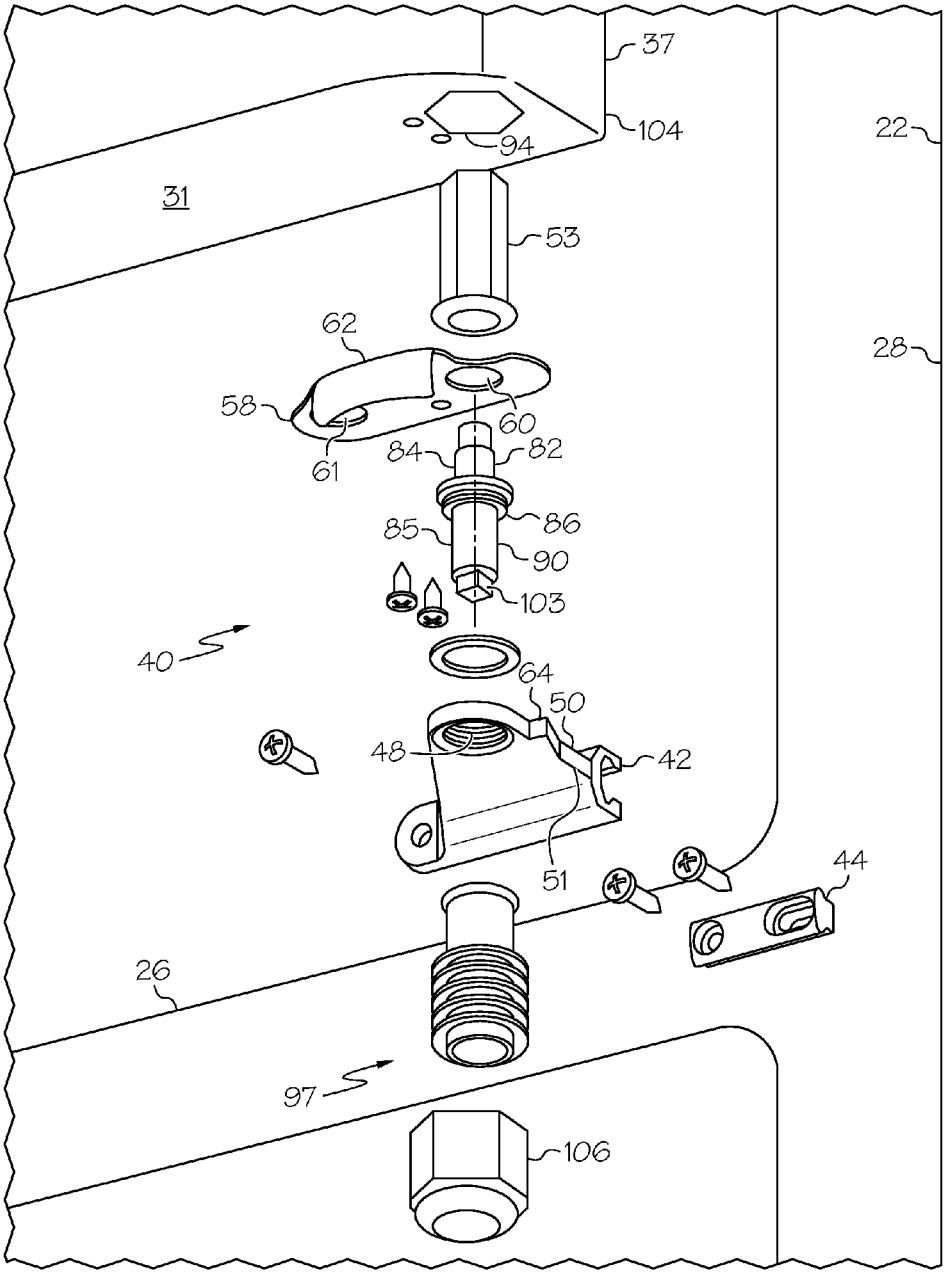
FIG. 7 shows an exploded view of a configuration for the hinge assembly, wherein the hinge assembly comprises a leg member.

Referring now to FIG. 7, the lower portion 85 of the hinge pin 82 is also selectively attachable to a leg member 96 configured to provide support for the hinge assembly 40. When the hinge assembly 40 is mounted below a door to secure and support a lower portion of the door to a refrigerator cabinet, force from the weight of the door and its contents is applied to the hinge bracket 42. This can create a significant amount of stress within the hinge bracket 42 if the hinge bracket 42 is cantilevered from the cabinet without any additional support below. The leg member 96 may be provided to extend between the hinge bracket 42 and the floor to provide support below the hinge bracket 42 and alleviate this stress. Additionally, when the door is rotated open (thus applying a tipping moment to the refrigerator cabinet 22), the leg member 96 can provide support below the door to reduce the moment and prevent the refrigerator from tipping forward.

Figure 8:
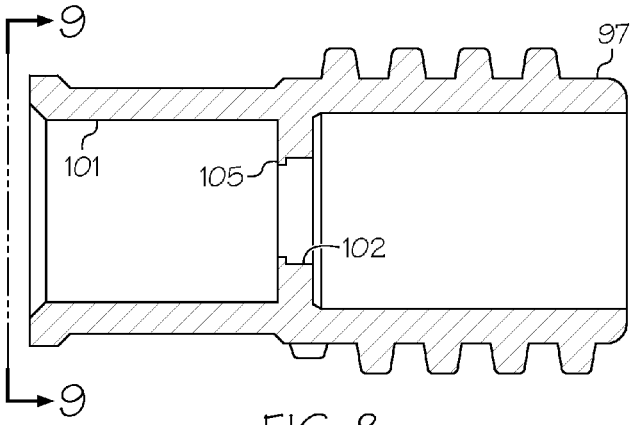
FIG. 8 is a cross-sectional view of a leg portion of the leg member.
Figure 9:
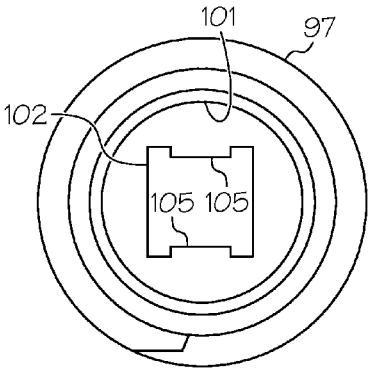
FIG. 9 is a side view of the leg portion shown in FIG. 8, taken from line 9-9.
Figure 10:
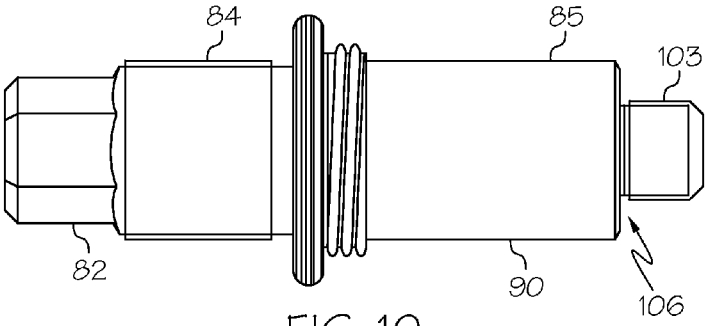
FIG. 10 shows a side view of a hinge pin of the hinge assembly.

As shown in FIG. 7, the hinge assembly 40 can be assembled and mounted to the cabinet 22 such that the side 50 of the hinge bracket 42 faces upward and the upper portion 84 of the hinge pin 82 extends vertically upward from the hinge bracket 42, through the first aperture 60 of the door stop member 58, and into a hole 94 in a bottom surface 31 of the door 37. Meanwhile, the lower portion 85 extends vertically downward from the hinge bracket 42 and into a leg member 96. The leg member 96 comprises a leg portion 97 which includes a bore 101 and a mating portion 102 that are configured to receive the lower portion 85 of the hinge pin 82, as shown in FIGS. 8 & 9. The bore 101 is substantially cylindrical to match the circumferential surface portion 90 of the lower portion 85. Additionally, the mating portion 102 mates with and engages a key portion 103 of the lower portion 85. Preferably, the key portion 103 and the mating portion 102 are non-circular in cross section so that when the key portion 103 mates with and engages the mating portion 102, the leg portion 97 is prohibited from rotating relative to the hinge pin 82. Additionally, the leg portion 97 can comprise one or more protrusions 105 and the lower portion 85 can comprise a recessed portion 106 (shown in FIG. 10) configured to cooperate with the one or more protrusions 105. When the lower portion 85 is inserted into the leg portion 97, the one or more protrusions 105 will snap into the recessed portion 106, thus attaching the lower portion 85 to the leg portion 97 and preventing the lower portion 85 from disengaging the leg portion 97.

Returning to FIG. 7, the leg member 96 can comprise a foot portion 106 which is configured to contact the floor. The foot portion 106 may be integral with the leg portion 97 or it may be a separate component. If separate, the foot portion 106 can be attached to the leg portion 97 via threads. By providing threads on the leg portion 97 for attachment of the foot portion 106, the overall length of the leg member 96 can be adjusted by tightening or loosening the foot portion 106 onto the leg portion 97. Thus, the length of the leg member 96 may be adjusted to accommodate for various arrangements where the hinge bracket 42 may not be the same distance from the floor. Moreover, when the key portion 103 of the hinge pin 82 and the mating portion 102 of the leg portion 97 are engaged, the leg portion 97 will be fixed relative to the door 37 and will not rotate during adjustment of the foot portion 106, allowing for easier adjustment of the foot portion 106.

When configured as shown in FIG. 7, the hinge assembly 40 can secure a bottom portion 104 of the door 37 so that the door 37 will pivot near the side wall 28. Additionally, the stop portion 62 of the door stop member 58 will properly engage with the protrusion 64 on the hinge bracket 42 as the door 37 opens to prohibit further rotation of the door 37 in the opening direction. Moreover, due to the design of the hinge plate 42, hinge pin 82, and the door stop member 58, the hinge assembly 40 may be reconfigured to secure a bottom portion the door 37 so that the door 37 will pivot near the side wall 30. To accomplish this alternate configuration, the hinge assembly 40 can be assembled and mounted to the cabinet 22 such that the side 51 of the hinge bracket 42 faces upward and the upper portion 84 of the hinge pin 82 extends vertically upward from the hinge bracket 42, through the second aperture 61 of the door stop member 58, and into a hole in the left side of the bottom surface 31. The lower portion 85 will extend vertically downward from the hinge bracket 42 and can be selectively attached to the leg member 96 to provide support for the hinge assembly 40. Moreover, the door stop member 58 will properly engage with the protrusion 64 on the hinge bracket 42 as the door 37 opens to prohibit further rotation of the door 37 in the opening direction.

Figure 11:
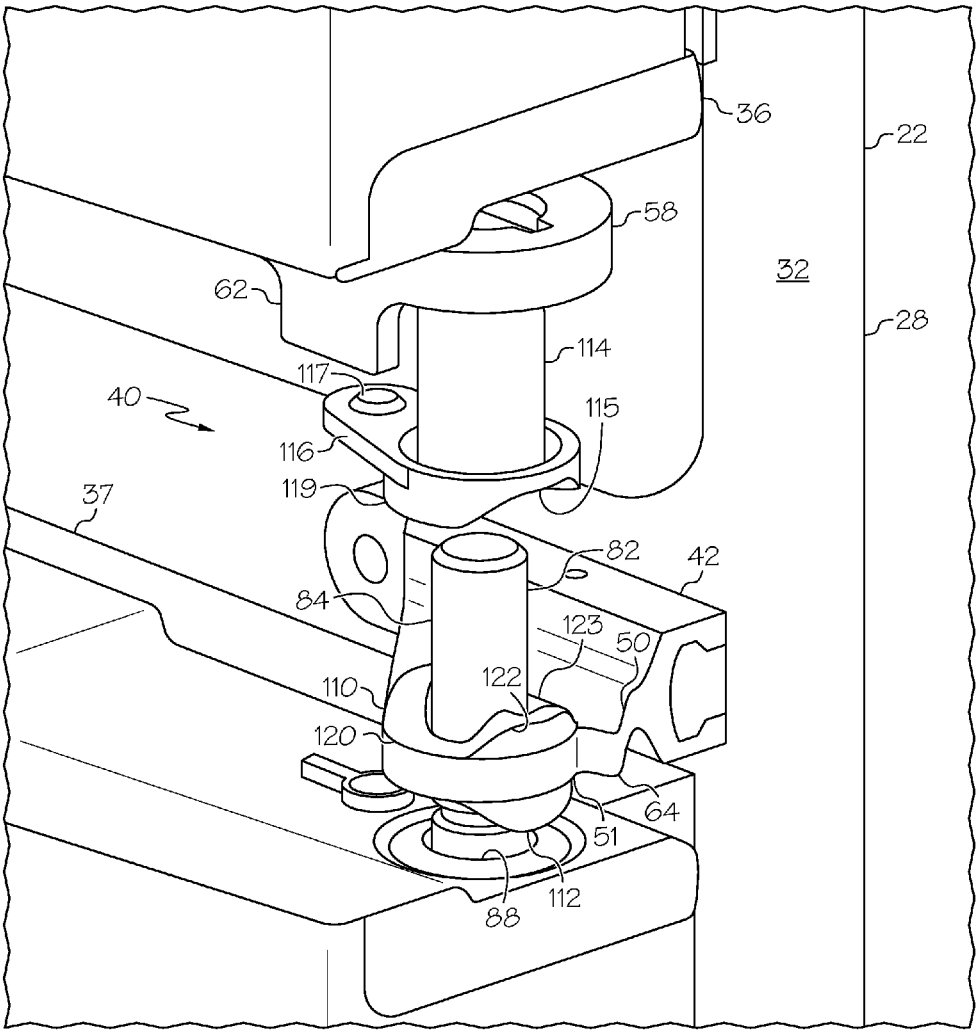
FIG. 11 shows an exploded view of a configuration for the hinge assembly, wherein a hinge bracket of the hinge assembly includes first and second cam surface portions.

Referring now to FIG. 11, an embodiment of the hinge assembly 40 is shown wherein the hinge bracket 42 comprises additional cam surface portions 110 and 112. The cam surface portion 110 is provided on the side 50 of the hinge bracket 42 and the cam surface portion 112 is provided on the side 51 of the hinge bracket 42. Additionally, a special spin bearing 114 is provided which comprises a cam surface portion 115 that is configured to cooperate with either of the cam surface portions 110 and 112 to prevent rotation of a door between a first and second position. The spin bearing 114 includes an inner bore portion configured to receive either one of the hinge pins 46, 82 of the hinge assembly 40. Additionally, the spin bearing 114 may be inserted into a hole in a bottom or top surface of a door to provide a bearing surface for the hinge pin to engage as the door rotates about the hinge pin. Moreover, the spin bearing 114 comprises an attachment portion 116 configured so that the spin bearing 114 may be fixed to the door. For example, the spin bearing 114 may be fixed to the door by a screw or bolt that extends though an aperture 117 in the attachment portion 116 and threads into the door, thus securing the spin bearing 114 to the door. When fixed to the door, the spin bearing 114 will rotate with the door about the hinge pin and the cam surface portion 115 of the spin bearing 114 will cooperate with whichever cam surface portion 110, 112 of the hinge bracket 42 that is facing the spin bearing 114.

Figure 12:
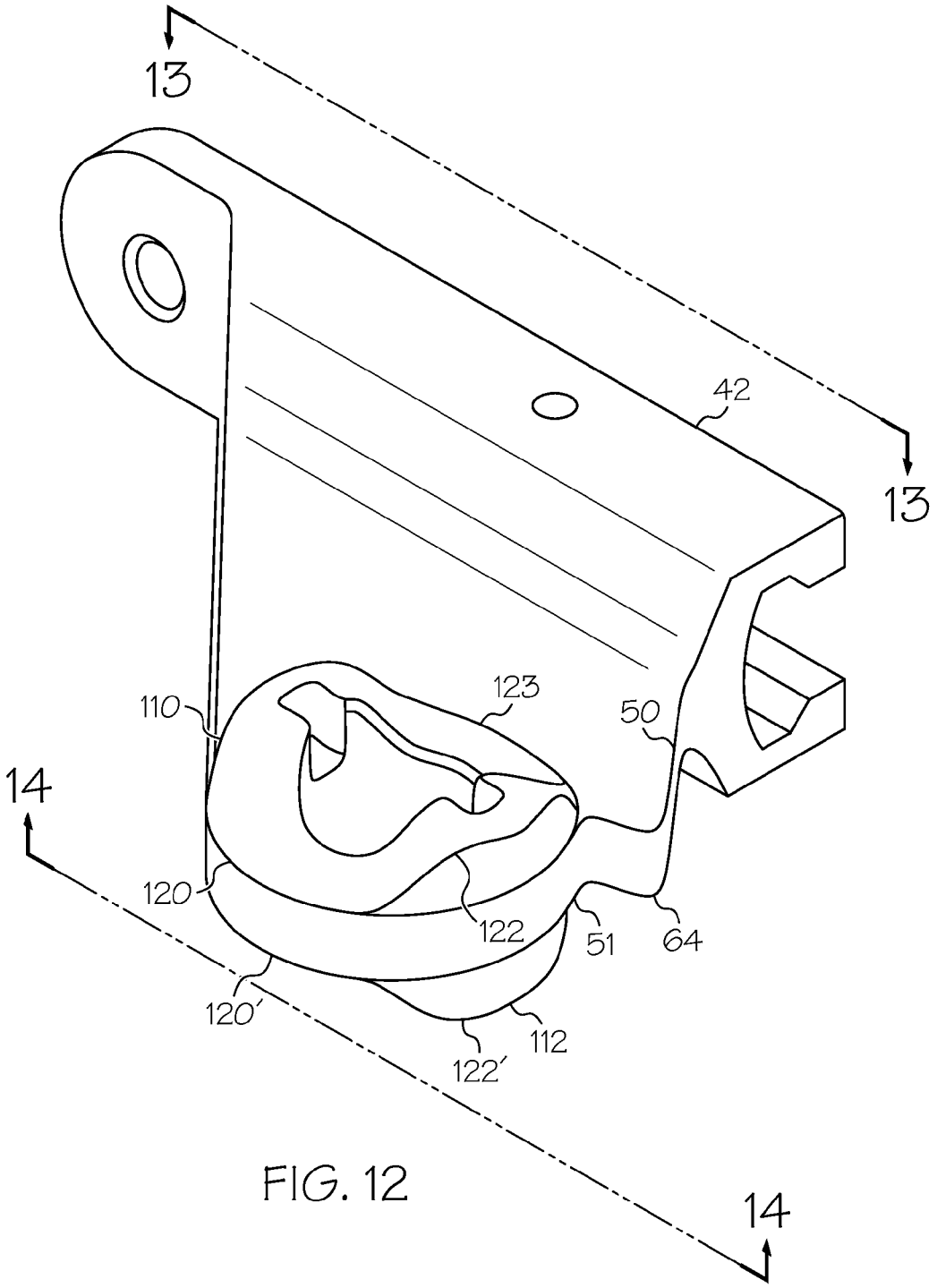
FIG. 12 shows a perspective view of the hinge bracket in FIG. 11.
Figure 13:
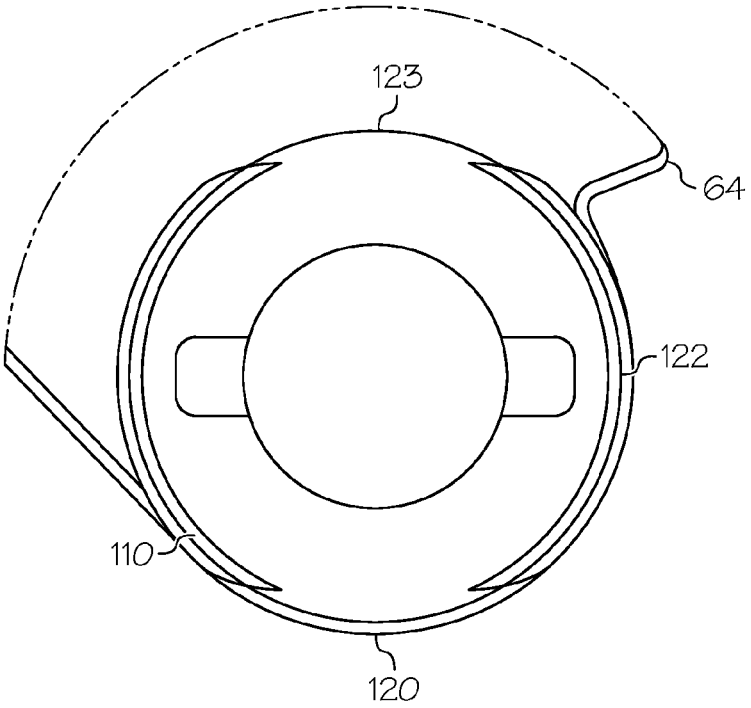
FIG. 13 shows a partial side view of the hinge bracket in FIG. 12, taken from line 13-13.

FIG. 11 shows a configuration of the hinge assembly 40 wherein the spin bearing 114 is inserted into the hole 49 of the door 36 and receives the upper portion 84 of the hinge pin 82. When the door 36 is in the closed position, engaging portion 119 of the cam surface portion 115 rests within lowered portion 120 of the cam surface portion 110. As the door 36 is rotated open, the engaging portion 119 will rotate about the hinge pin 82 and engage raised portion 122 of the cam surface portion 110. Further rotation of the door 36 in the opening direction will cause the spin bearing 114 (and the door 36 which is attached thereto) to rise and then fall as the engaging portion 119 travels over and past the apex of the raised portion 122 and into lowered portion 123 (shown in FIGS. 12 & 13). However, the weight of the door 36 and gravity will prevent the door 36 and the spin bearing 114 from rising unless sufficient force is applied to the door 36 during rotation to overcome the effects of gravity. Thus, in order to further rotate the door 36 in the opening direction, sufficient force must be applied to the door 36 so that the engaging portion 119 will travel over and past the apex of the raised portion 122. As such, the door 36 is prevented from rotating from the closed position to a fully open position without such required force. However, once the engaging portion 119 travels past the apex of the raised portion 122 and begins to descend into the lowered portion 123, the weight of the door 36 and the effect of gravity will force the door 36 to continue rotating open until the engaging portion 119 fully passes the raised portion 122 and the door is in a fully open position.

Once the door 36 is in the fully open position, engaging portion 119 of the cam surface portion 115 will rest within lowered portion 123. As the door 36 is rotated back to the closed position, the engaging portion 119 will once again engage the raised portion 122 of the cam surface portion 110. Further rotation of the door 36 in the closing direction will similarly cause the spin bearing 114 (and the door 36 which is attached thereto) to rise and then fall as the engaging portion 119 travels over and past the apex of the raised portion 122 and into lowered portion 120. Thus, in order to further rotate the door 36 in the closing direction, sufficient force must be applied to the door 36 to overcome the effects of gravity so that the engaging portion 119 will travel over and past the apex of the raised portion 122. As such, the door 36 is prevented from rotating from the fully open position to the closed position without such required force. However, once the engaging portion 119 travels past the apex of the raised portion 122 and begins to descend into the lowered portion 120, the weight of the door 36 and the effect of gravity will force the door 36 to continue rotating in the closing direction until the engaging portion 119 fully passes the raised portion 122 and the door is in the closed position, thus ensuring that the door 36 properly closes against the cabinet 22.

Figure 14:
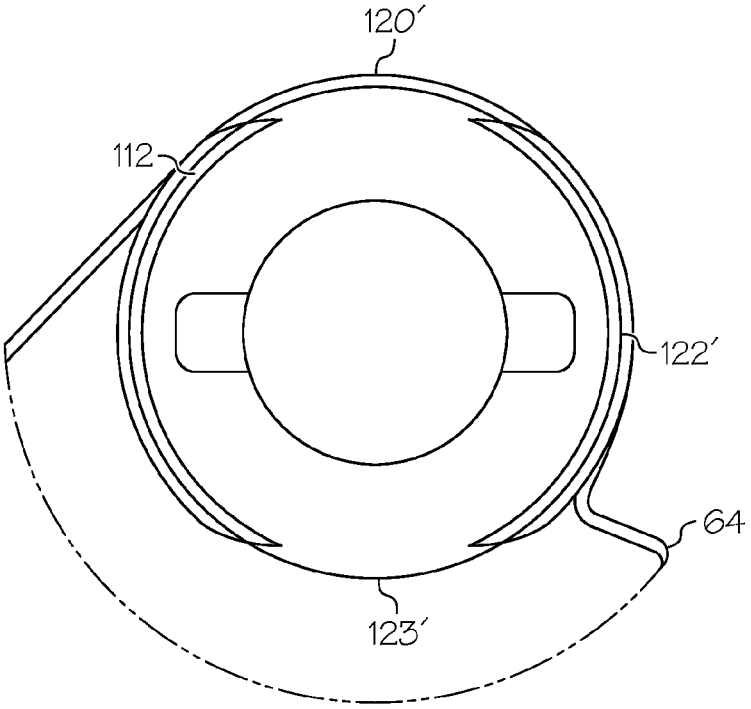
FIG. 14 shows a partial side view of the hinge bracket in FIG. 12, taken from line 14-14.

The cam surface portion 115 of the spin bearing 114 and the cam surface portions 110 and 112 of the hinge bracket 42 are designed so that they may similarly operate as described above for multiple configurations and orientations of the hinge assembly 40. FIG. 11 shows a configuration of the hinge assembly 40 wherein the doors 36 and 37 pivot near the right side wall 28 and the cam surface portion 115 is configured to cooperate with the cam surface portion 110 to prevent rotation of the door 36 between an open and closed position. However, the hinge assembly 40 may be configured such that the doors 36 and 37 pivot near the left side wall 30. To accomplish this alternate configuration, the hinge assembly 40 can be assembled and mounted to the cabinet 22 such that the side 51 of the hinge bracket 42 and the cam surface portion 112 face upward and the upper portion 84 of the hinge pin 82 extends vertically upward from the hinge bracket 42, through the second aperture 61 of the door stop member 58, and into a hole (such as hole 70) in the left side of the bottom surface 29. The spin bearing 114 can be inserted into the hole so that the cam surface portion 115 faces and engages with the cam surface portion 112. The profile of the cam surface portion 112 mirrors the profile of the cam surface portion 110. As shown in FIG. 14, portions 120', 122', and 123' of the cam surface portion 112 are configured similar to portions 120, 122, and 123 of the cam surface portion 110. Thus, the cam surface portion 115 will similarly cooperate with the portions 120', 122', and 123' of the cam surface portion 112 to prevent rotation of the door 36 between an open and closed position when pivoting near the left side wall 30. Since the cam surface portion 115 of the spin bearing 114 is configured to cooperate with the hinge bracket 42 regardless of which side 50, 51 of the hinge bracket 42 faces the spin bearing 114, the spin bearing 114 may be used in any of the hinge assembly 40 configurations discussed earlier above to prevent rotation of a door between a first and second position, provided the hinge bracket 42 additionally comprises the cooperating cam surface portions 110 and 112.

It should be apparent that the foregoing relates only to certain embodiments of the present application and that numerous changes and modifications may be made herein by one of ordinary skill in the art without departing from the general spirit and scope of the invention as defined by the following claims and equivalents thereof.

What is claimed is:

1. A hinge assembly for pivotally mounting a door on a refrigerator cabinet, the refrigerator cabinet comprising a top wall, a bottom wall, a pair of opposed side walls extending between the bottom and top wall, and a face that is normal to the top wall, bottom wall, and opposed side walls, the hinge assembly comprising:

a hinge bracket that is attachable to the cabinet, the hinge bracket comprising a threaded aperture having a first end and a second end;

a hinge pin defining an axis about which the door can rotate, wherein the hinge pin comprises a threaded portion that is threadably insertable into either end of the threaded aperture to threadably engage the threaded aperture; and a door stop member configured to rotate about the axis and prohibit rotation of the door beyond a certain position, wherein the hinge bracket comprises a protrusion configured to cooperate with the door stop member to prohibit rotation of the door beyond a certain position.

2. The hinge assembly of claim 1, wherein:

the door comprises a top surface and a bottom surface that are arranged substantially parallel to the top wall and bottom wall;

the hinge bracket, hinge pin, and door stop member are configured to permit mounting of the door with the hinge assembly such that the threaded portion is threadably inserted into the first end of the threaded aperture and the hinge pin extends vertically downward from the hinge bracket into a hole in the top surface of the door; and the hinge bracket, hinge pin, and door stop member are configured to permit mounting of the door with the hinge assembly such that the threaded portion is threadably inserted into the second end of the threaded aperture and the hinge pin extends vertically upward from the hinge bracket into a hole in the bottom surface of the door.

3. The hinge assembly of claim 1, wherein:

the pair of opposed side walls comprises a first side wall and a second side wall, the hinge bracket, hinge pin, and door stop member are configured to permit mounting of the door with the hinge assembly such that the door pivots near the first side wall; and the hinge bracket, hinge pin, and door stop member are configured to permit mounting of the door with the hinge assembly such that the door pivots near the second side wall.

4. The hinge assembly of claim 1, wherein the door stop member is fixed to the door and comprises a first aperture and a second aperture that are both sized such that the hinge pin can extend therethrough, further wherein the hinge pin extends through only one of the first and second apertures.

5. The hinge assembly of claim 1, wherein the hinge bracket comprises a first cam surface that cooperates with a second cam surface, the first and second cam surfaces being configured to prevent rotation of the door between a first position and a second position.

6. The hinge assembly of claim 1, wherein the hinge pin comprises an upper portion extending from the hinge bracket in a first direction and a lower portion extending from the hinge bracket in a second direction that is opposite the first direction, further wherein the upper portion and the lower portion both extend from opposite sides of the threaded portion.

7. The hinge assembly of claim 6, wherein the upper portion extends into a hole in the door and the lower portion is selectively attachable to a foot member and configured for insertion into a second hole in a second door.

8. The hinge assembly of claim 1, further comprising a mounting block attached to the cabinet, wherein the hinge bracket is slidably engaged with the mounting block.

9. A hinge assembly mounting a door on a cabinet of a refrigerator comprising:

a hinge bracket attached to the cabinet; and a hinge pin defining an axis about which the door can rotate, the hinge pin comprising an upper portion extending from the hinge bracket in a first direction and a lower portion extending from the hinge bracket in a second direction that is opposite the first direction, wherein the lower portion comprises a circumferential surface portion and a key portion, wherein the upper portion extends into a hole in the door, wherein the upper portion of the hinge pin is positioned on one side of the hinge bracket and the circumferential surface portion and the key portion of the hinge pin are positioned on another side of the hinge bracket opposite to the upper portion, and wherein the hinge bracket comprises a threaded aperture and the hinge pin comprises a threaded portion threadably received within the threaded aperture, wherein the upper portion and the lower portion of the hinge pin both extend from opposite sides of the threaded portion.

10. The hinge assembly of claim 9, wherein the lower portion is selectively attached to a leg member.

11. The hinge assembly of claim 10, wherein the key portion engages a mating portion in a leg portion of the leg member and prohibits rotation of the leg portion relative to the hinge pin.

12. The hinge assembly of claim 11, wherein the lower portion comprises a recessed portion that cooperates with one or more protrusions within the leg portion.

13. A hinge assembly for pivotally mounting a door on a refrigerator cabinet, the refrigerator cabinet comprising a top wall, a bottom wall, a pair of opposed side walls extending between the bottom and top wall, and a face that is normal to the top wall, bottom wall, and opposed side walls, the hinge assembly comprising:

a hinge bracket that is attachable to the cabinet, the hinge bracket having a first side and an opposing second side;

a hinge pin defining an axis about which the door can rotate, the hinge pin configured for insertion into a hole in the door, the hinge pin comprising a component being removably attachable to the hinge bracket; and a door stop member configured to prohibit rotation of the door beyond a certain position, the door stop member comprising a first aperture and a second aperture, wherein the component of the hinge pin extends through only one of the first and second apertures, wherein the hinge bracket, the hinge pin and door stop member can be assembled according to a first configuration wherein the hinge pin extends from the first side of the bracket and through the first aperture of the door stop member, wherein the hinge bracket, the hinge pin and door stop member can be assembled according to a second configuration wherein the hinge pin extends from the second side of the bracket and through the second aperture of the door stop member, and wherein the hinge bracket comprises a protrusion configured to cooperate with the door stop member to prohibit rotation of the door beyond the certain position.

14. The hinge assembly of claim 13, wherein:

the door comprises a top surface and a bottom surface that are arranged substantially parallel to the top wall and bottom wall;

the hinge bracket, hinge pin, and door stop member are configured to permit mounting of the door with the hinge assembly such that the hinge pin extends vertically downward from the hinge bracket into a hole in the top surface of the door; and the hinge bracket, hinge pin, and door stop member are configured to permit mounting of the door with the hinge assembly such that the hinge pin extends vertically upward from the hinge bracket into a hole in the bottom surface of the door.

15. The hinge assembly of claim 13, wherein the door stop member is configured to rotate with the door about the axis.

16. The hinge assembly of claim 13, wherein the door stop member is fixed to the door.

17. A hinge assembly for pivotally mounting a door on a refrigerator cabinet, the refrigerator cabinet comprising a top wall, a bottom wall, a pair of opposed side walls extending between the bottom and top wall, and a face that is normal to the top wall, bottom wall, and opposed side walls, the hinge assembly comprising:

a hinge bracket that is attachable to the cabinet, the hinge bracket having a first side and an opposing second side;

a hinge pin defining an axis about which the door can rotate, the hinge pin configured for insertion into a hole in the door, the hinge pin comprising a component being removably attachable to the hinge bracket; and a door stop member configured to prohibit rotation of the door beyond a certain position, the door stop member comprising a first aperture and a second aperture, wherein the component of the hinge pin extends through only one of the first and second apertures, wherein the hinge bracket, the hinge pin and door stop member can be assembled according to a first configuration wherein the hinge pin extends from the first side of the bracket and through the first aperture of the door stop member, wherein the hinge bracket, the hinge pin and door stop member can be assembled according to a second configuration wherein the hinge pin extends from the second side of the bracket and through the second aperture of the door stop member, and wherein the hinge bracket comprises a threaded aperture and the hinge pin comprises a threaded portion threadably received within the threaded aperture, wherein the threaded aperture is threaded from a first end to a second end of the threaded aperture.

* * * * *